US009764889B2

(12) United States Patent
Xu

(10) Patent No.: US 9,764,889 B2
(45) Date of Patent: Sep. 19, 2017

(54) AUTOMATIC SHOE COVER DISPENSER WITH SHOE COVER CARTRIDGE

(71) Applicant: OTO Industry (Wuhan) Co., Ltd., HanChuan, HuBei (CN)

(72) Inventor: Liang Jie Xu, Shanghai (CN)

(73) Assignee: OTO Industry (Wuhan) Co., Ltd., HanChuan, HuBei (CN)

( * ) Notice: Subject to any disclaimer, the term of this patent is extended or adjusted under 35 U.S.C. 154(b) by 0 days.

(21) Appl. No.: 14/973,737

(22) Filed: Dec. 18, 2015

(65) Prior Publication Data

US 2016/0107824 A1 Apr. 21, 2016

Related U.S. Application Data

(63) Continuation-in-part of application No. 14/515,544, filed on Oct. 16, 2014.

(51) Int. Cl.

| | |
|---|---|
| ***B65H 1/08*** | (2006.01) |
| ***B65D 83/08*** | (2006.01) |
| ***A43B 3/16*** | (2006.01) |
| ***A43D 999/00*** | (2006.01) |

(52) U.S. Cl.

CPC ..... *B65D 83/0894* (2013.01); *A43B 3/163* (2013.01); *A43D 999/00* (2013.01); *B65D 83/0817* (2013.01); *A43D 2200/30* (2013.01)

(58) Field of Classification Search

CPC ..... B65H 1/00; B65H 2405/50; B65H 2701/1212; B65D 83/0894; B65D 83/0817; A43B 3/163; A43D 999/00; A43D 2200/30

USPC ..... 223/113; 221/191, 171, 232, 111, 112, 221/56; 206/477; 53/459

See application file for complete search history.

(56) References Cited

U.S. PATENT DOCUMENTS

| | | | | |
|---|---|---|---|---|
| 3,775,793 | A * | 12/1973 | Casavant | A43B 3/163 12/1 R |
| 6,543,075 | B2 * | 4/2003 | Gultekin | A47G 25/80 12/1 R |
| 7,448,521 | B2 * | 11/2008 | Hu | A43B 3/163 12/1 R |
| 7,775,396 | B2 * | 8/2010 | Xu | B65H 1/00 221/171 |
| 2006/0144879 | A1 * | 7/2006 | Hu | A43B 3/163 223/111 |
| 2007/0163912 | A1 * | 7/2007 | Chen | A43B 3/16 206/477 |
| 2007/0204568 | A1 * | 9/2007 | Chen | A43B 3/163 53/459 |

(Continued)

*Primary Examiner* — Rakesh Kumar
(74) *Attorney, Agent, or Firm* — Raymond Y. Chan; David and Raymond Patent Firm

(57) ABSTRACT

A shoe cover cartridge includes two guiding arms and a plurality of shoe covers overlapped in a sequential manner to define a standby shoe cover and a subsequent shoe cover. Front and rear interlocking units are provided at front and rear sides of each of the shoe cover respectively and are slidably engaged with the guiding arms at a position that the front interlocking unit at the subsequent shoe cover is located in front of the rear interlocking unit at the standby shoe cover along the guiding arms. Therefore, when the standby shoe cover is pulled for dispensing, the subsequent shoe cover is pulled by the standby shoe to dispense the shoe covers in a sequential order.

11 Claims, 18 Drawing Sheets

(56) References Cited

U.S. PATENT DOCUMENTS

| | | | | |
|---|---|---|---|---|
| 2008/0237277 | A1* | 10/2008 | Xu | B65H 1/00 222/526 |
| 2010/0288800 | A1* | 11/2010 | Xu | A43B 3/106 223/113 |
| 2011/0272440 | A1* | 11/2011 | Heller | A47G 25/907 223/113 |
| 2013/0270288 | A1* | 10/2013 | Xu | A43B 3/106 221/1 |
| 2016/0107824 | A1* | 4/2016 | Xu | A43D 999/00 221/56 |

* cited by examiner

AUTOMATIC SHOE COVER DISPENSER WITH SHOE COVER CARTRIDGE

CROSS REFERENCE OF RELATED APPLICATION

This is a Continuation-In-Part application that claims the benefit of priority under 35 U.S.C. §119 to a non-provisional application having an application Ser. No. 14/515,544 and a filing date of Oct. 16, 2014.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an automatic shoe-cover machine, and more particularly to an automatic shoe cover dispenser with a shoe cover cartridge, wherein the shoe cover cartridge is replaceable with the shoe cover dispenser to automatically and continuously dispense the shoe covers of the shoe cover cartridge.

Description of Related Arts

Automatic shoe cover machine is a device designed to solve the problem of having people to take off their shoes before entering a room under sanitary control, wherein the shoe cover machine can dispense the shoe cover to wrap the shoe of the user. Accordingly, the automatic shoe cover machines are widely used in public health establishments, like hospital, laboratory, living room and other sanitation environments. Accordingly, the conventional shoe cover is adapted to dispense the shoe covers one-by-one via different dispensing mechanisms. No matter which type of dispensing mechanism is used, the shoe covers must be overlapped and stacked in series.

The first type of dispensing mechanism is that the shoe covers are affixed one-by-one, wherein a rear edge of the former shoe cover is attached to a front edge of the following shoe cover. As a result, during the former shoe cover is pulled out of the machine for dispensing, the following shoe cover is also pulled by the former shoe cover. However, the major drawback of this dispensing mechanism is that the production process for packaging the shoe covers is relatively complicated since the shoe covers must be attached one-by-one. The installation of the shoe covers is inconvenient that the shoe covers must be carefully loaded in the dispensing mechanism. Once the connection between two sequent shoe covers is broken, the shoe covers cannot be dispensed anymore. In other words, this shoe cover arrangement is not designed for mass production.

Another type of dispensing mechanism is that the shoe covers are individually stacked with each other, wherein the dispensing mechanism incorporates with a motorized device to dispense the shoe covers one-by-one. Accordingly, since the motorized device is used, the mechanism must be electrically connected to a power source. In other words, the mechanism must be electrically plugged to the electric outlet or must be incorporated with a battery. Without any electrical power, the dispensing mechanism will not be operated. In addition, the shoe covers must be installed into the dispensing mechanism one-by-one so as to complicate the installation process of the shoe covers.

SUMMARY OF THE PRESENT INVENTION

The invention is advantageous in that it provides an automatic shoe cover dispenser with a shoe cover cartridge, wherein the shoe cover cartridge is replaceable with the shoe cover dispenser to automatically and continuously dispense the shoe covers of the shoe cover cartridge.

Another advantage of the invention is to provide an automatic shoe cover dispenser, wherein the shoe cover cartridge is configured as a shoe cover cartridge to be loaded to the automatic shoe cover dispenser, so as to simplify the installation process of the shoe cover cartridge.

Another object of the present invention is to provide an automatic shoe cover dispenser, which is simple in structure with inexpensive manufacture and maintenance cost. In particular, no motorized device is required to dispense the shoe covers for the automatic shoe cover dispenser. In other words, the automatic shoe cover dispenser does not require any electrical power for dispensing operation.

Another object of the present invention is to provide an automatic shoe cover dispenser, wherein the shoe covers are packed together without attaching with each other. In particular, the following shoe cover is interlocked by the former shoe cover, such that after the former shoe cover is pulled and dispensed, the following shoe cover is automatically pulled by the former shoe cover to its standby position.

Another object of the present invention is to provide an automatic shoe cover dispenser, wherein each of the shoe covers is orderly pulled to enlarge its opening at the standby position.

Another object of the present invention is to provide an automatic shoe cover dispenser, which does not require to alter the original structural design of the automatic shoe cover dispenser, so as to minimize the manufacturing cost of the automatic shoe cover dispenser incorporating with the shoe cover cartridge.

Another object of the present invention is to provide an automatic shoe cover dispenser, wherein no expensive or complicated structure is required to employ in the present invention in order to achieve the above mentioned objects. Therefore, the present invention successfully provides an economic and efficient solution for providing a simple dispensing configuration for the automatic shoe cover dispenser.

Additional advantages and features of the invention will become apparent from the description which follows, and may be realized by means of the instrumentalities and combinations particular point out in the appended claims.

According to the present invention, the foregoing and other objects and advantages are attained by an automatic shoe cover dispenser which comprises a dispenser system and a shoe cover cartridge.

The dispenser system has a cartridge cavity and a shoe disposing opening, and defines a dispensing direction from the cartridge cavity to the shoe disposing opening.

The shoe cover cartridge is replaceably disposed in the cartridge cavity, wherein said shoe cover cartridge comprises a guiding unit which comprises two spaced apart elongated guiding arms, and a plurality of shoe covers overlapped with each other in a sequential manner that one of the shoe covers is pulled into an open-up condition as a standby shoe cover and a subsequent shoe cover followed by the standby shoe cover. Each of the shoe covers comprises a cover body having a cover opening defined at a top peripheral edge, a front interlocking unit provided at a front side of each of the cover bodies, and a rear interlocking unit provided at a rear side of each of the cover bodies, wherein the front and rear interlocking units are slidably engaged with the guiding arms at a position that the front interlocking unit at the subsequent shoe cover is located in front of the rear interlocking unit at the standby shoe cover along the guiding arms. Therefore, when the standby shoe cover is pulled to the shoe disposing opening at the dispensing direction, the subsequent shoe cover is pulled by the standby shoe from the cartridge cavity, so as to dispense the shoe covers in a sequential order.

In accordance with another aspect of the invention, the present invention comprises a method of dispensing shoe cover to be worn on a shoe of a user, comprising the following steps.

(1) Provide a shoe cover cartridge by the following steps.

(1.1) Provide a plurality of shoe covers each having a cover opening, a front interlocking unit at a front side of each of the shoe covers, and a rear interlocking unit provided at a rear side of each of the shoe covers.

(1.2) Overlappedly stack the shoe covers with each other in a sequential manner that one of the shoe covers is pulled into an open-up condition as a standby shoe cover and a subsequent shoe cover followed by the standby shoe cover.

(1.3) Slidably engage the shoe covers at two spaced apart elongated guiding arms via the front and rear interlocking units at a position that the front interlocking unit at the subsequent shoe cover is located in front of the rear interlocking unit at the standby shoe cover along the guiding arms.

(2) Load the shoe cover cartridge in a cartridge cavity of a dispenser system.

(3) Pull the standby shoe cover from the cartridge cavity of the dispenser system to a shoe disposing opening thereof for enabling the shoe of the user to dispose in the standby shoe cover through the cover opening.

(4) Automatically pull the subsequent shoe cover by the standby shoe cover after the standby shoe cover is dispensed, so as to dispense the shoe covers in a sequential order.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
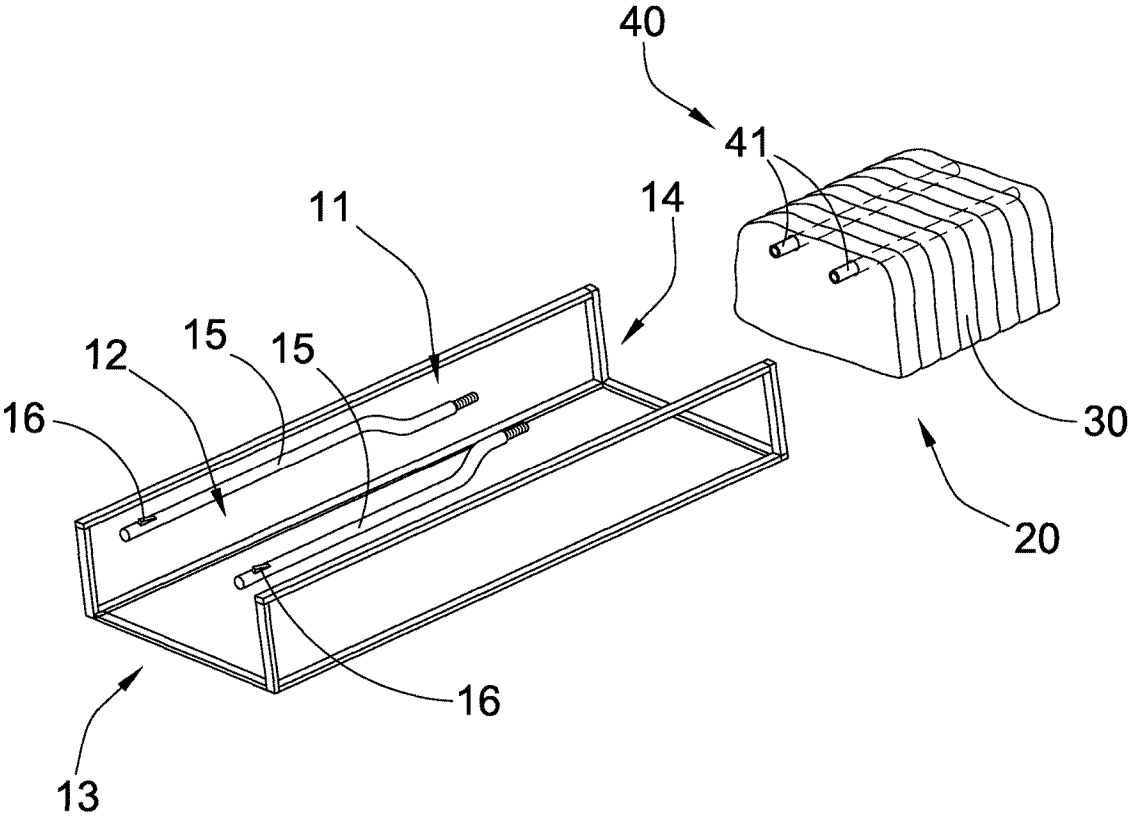
FIG. 1 is a perspective view of an automatic shoe cover dispenser according to a preferred embodiment of the present invention.

Referring to FIG. 1 of the drawings, an automatic shoe cover dispenser according to a preferred embodiment is illustrated, wherein the automatic shoe cover dispenser comprises a dispenser system 10 and a shoe cover cartridge 20.

The dispenser system 10 has a cartridge cavity 11 and a shoe disposing opening 12, and defines a dispensing direction from the cartridge cavity 11 to the shoe disposing opening 12. According to the preferred embodiment, the cartridge cavity 11 is formed at a rear portion of the dispenser system 10 and the shoe disposing opening 12 is formed at a front portion of the dispenser system 10 at a top side thereof. Therefore, the shoe disposing opening 12 is a top opening at the front portion of the dispenser system 10. The dispenser system 10 further has a front opening 13 communicating with the shoe disposing opening 12 and a rear opening 14 communicating with the cartridge cavity 11.

The shoe cover cartridge 20 is replaceably disposed in the cartridge cavity 11 of the dispenser system 10, wherein the shoe cover cartridge 20 can be loaded or unloaded to the cartridge cavity 11 of the dispenser system 10 through the rear opening 14 thereof. According to the preferred embodiment, the shoe cover cartridge 20 comprises a plurality of shoe covers 30 overlapped with each other in a sequential manner to be loaded in the cartridge cavity 11 of the dispenser system 10 to form a stack of shoe cover. One of the shoe covers 30, i.e. the foremost position of the shoe cover 30 in the stack of shoe cover, is pulled into an open-up condition as a standby shoe cover 30A and a subsequent shoe cover 30B followed by the standby shoe cover 30A. In other words, the dispenser system 10 will firstly dispense the standby shoe cover 30A and then the subsequent shoe cover 30B in a sequential order. Each of the shoe covers 30 is made of fabric or plastic material that can be folded and stacked with each other.

Figure 3:
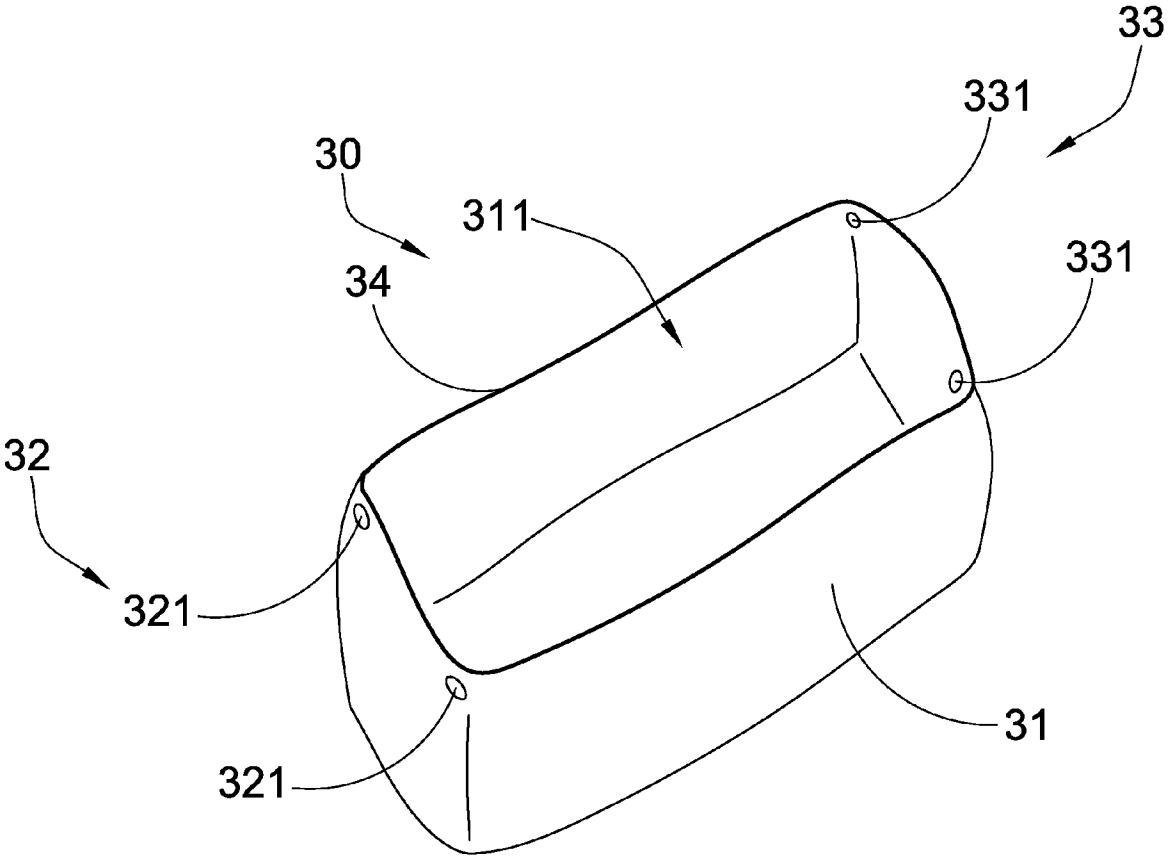
FIG. 3 is a perspective view of the shoe cover according to the above preferred embodiment of the present invention.

As shown in FIG. 3, each of the shoe covers 30 comprises a cover body 31 having a cover opening 311 defined at a top peripheral edge, a front interlocking unit 32 provided at a front side of the cover body 31, and a rear interlocking unit 33 provided at a rear side of cover body 31, wherein the shoe of the user is able to dispose in the cover body 31 through the cover opening 311, such that the shoe cover 30 will wrap around the shoe of the user. Accordingly, the top peripheral edge of each of the shoe covers 30 is an elastic edge that an elastic element 34 is provided at the top peripheral edge of each of the shoe covers 30 to shrink the size of the cover opening 311 of the shoe cover 30.

As shown in FIG. 3, the first interlocking unit 32 contains two spaced apart first interlocking holes 321 formed at the front side of the cover body 31 below the top peripheral edge thereof. Each of the first interlocking holes 321 is a through hole formed at the front side of the cover body 30 close to the sidewall thereof. In other words, a distance between the two first interlocking holes 321 is slightly smaller than a width of the cover body 30 between two sidewalls.

Likewise, the second interlocking unit 33 contains two spaced apart second interlocking holes 331 formed at the rear side of the cover body 31 below the top peripheral edge thereof. Each of the second interlocking holes 331 is also a through hole formed at the rear side of the cover body 30 close to the sidewall thereof. In other words, a distance between the two second interlocking holes 331 is slightly smaller than a width of the cover body 30 between two sidewalls. Accordingly, the first and second interlocking holes 321, 331 are preferably identical that the first interlocking holes 321 are aligned with the second interlocking holes 331 respectively.

The shoe cover cartridge 20 further comprises a guiding unit 40 which comprises two spaced apart elongated guiding arms 41 extended parallelly with each other. Accordingly, the front and rear interlocking units 321, 331 are slidably engaged with the guiding arms 41 at a position that the front interlocking unit 321 at the subsequent shoe cover 30B is located in front of the rear interlocking unit 331 at the standby shoe cover 30A along the guiding arms 41, such that when the standby shoe cover 30A is pulled to the shoe disposing opening 12 at the dispensing direction, the subsequent shoe cover 30B is pulled by the standby shoe cover 30A from the cartridge cavity 11, so as to dispense the shoe covers 30 in a sequential order. It is worth mentioning that the standby shoe cover 30A does not physically connect to the subsequent shoe cover 30B by any connection means. However, the interlocking position between the standby shoe cover 30A and the subsequent shoe cover 30B at the guiding arm 41 will ensure the subsequent shoe cover 30B to be pulled by the standby shoe cover 30A during the dispensing operation.

Figure 4:
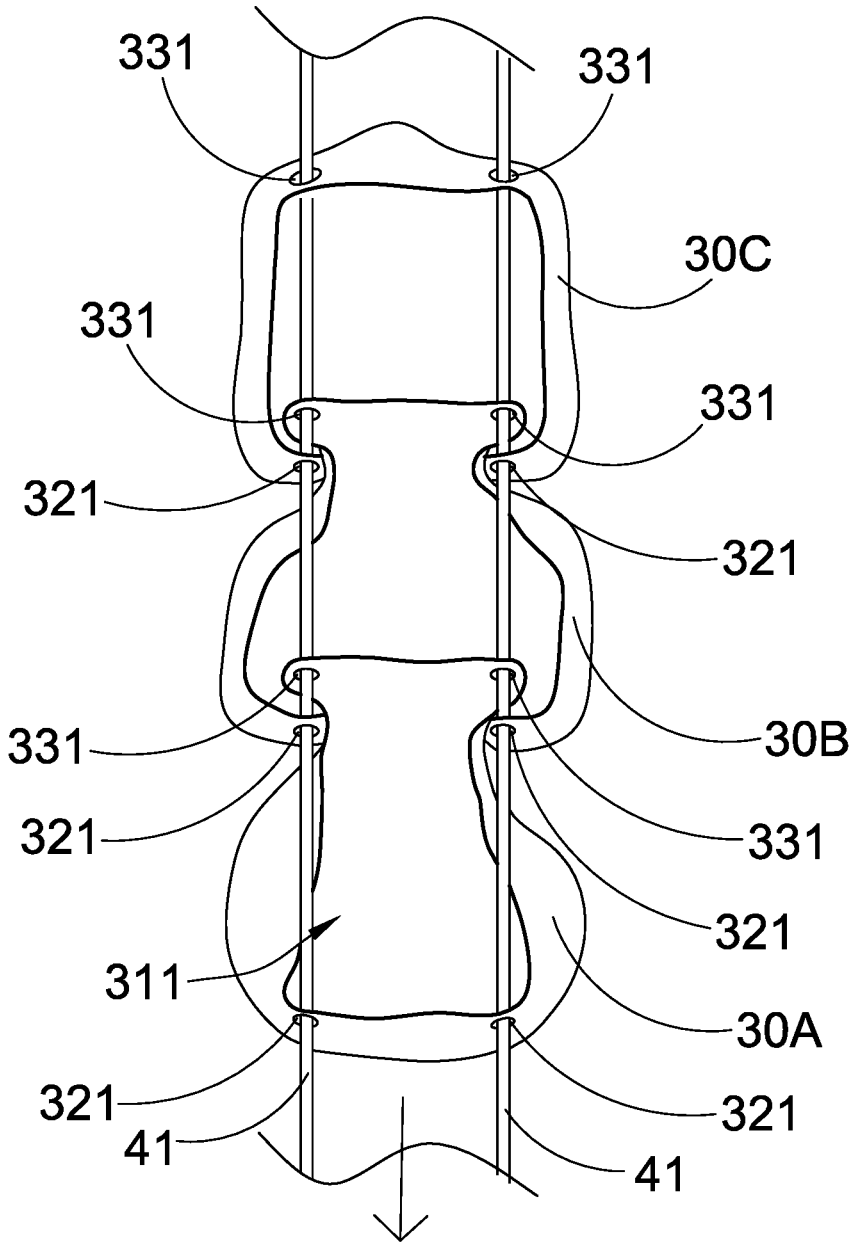
FIG. 4 illustrates the shoe covers being interlocked with each other according to the above preferred embodiment of the present invention.

As shown in FIG. 4, three shoe covers 30 are shown the interlocking configuration at the guiding arms, wherein the first shoe cover 30 is embodied as the standby shoe cover 30A, the second shoe cover 30 is embodied as the subsequent shoe cover 30B followed by the standby shoe cover, and the third shoe cover 30 is embodied as a third shoe cover 30C followed by the subsequent shoe cover 30B. As it is mentioned above, the first and second interlocking units 32, 33 are the first and second interlocking holes 321, 331 respectively.

The guiding arms 41 extend through all the first and second interlocking holes 321, 331 of the shoe covers 30A, 30B, 30C. In particular, the guiding arms 41 are arranged to slidably extend through the first interlocking holes 321 at the front side of the standby shoe cover 30A such that the front side of the standby shoe cover 30A is located at the foremost position to be pulled firstly. The guiding arms 41 are arranged to slidably extend through the second interlocking holes 331 at the rear side of the standby shoe cover 30A such that the standby cover shoe 30A is slidably supported at the guiding arms 41. Likewise, the guiding arms 41 are arranged to slidably extend through the first and second interlocking holes 321, 331 of the subsequent shoe cover 30B and the third shoe cover 30C such that the subsequent shoe cover 30B and the third shoe cover 30C are slidably supported at the guiding arms 41.

As shown in FIG. 4, the interlocking configuration of the shoe covers 30 is that the first interlocking holes 321 of the subsequent shoe cover 30B is located in front of the second interlocking hole 331 of the standby shoe cover 30A along the guiding arms 41. In other words, the guiding arms 41 are arranged to first extend through the second interlocking hole 331 of the standby shoe cover 30A and then the first interlocking holes 321 of the subsequent shoe cover 30B. Likewise, the first interlocking holes 321 of the third shoe cover 30C is located in front of the second interlocking hole 331 of the subsequent shoe cover 30B along the guiding arms 41. As a result, when the standby shoe cover 30A is pulled forwardly, the rear side of the standby shoe cover 30A will pull the front side of the subsequent shoe cover 30B forward, so as to dispense the shoe covers 30 one-by-one in a sequential order.

Figure 2:
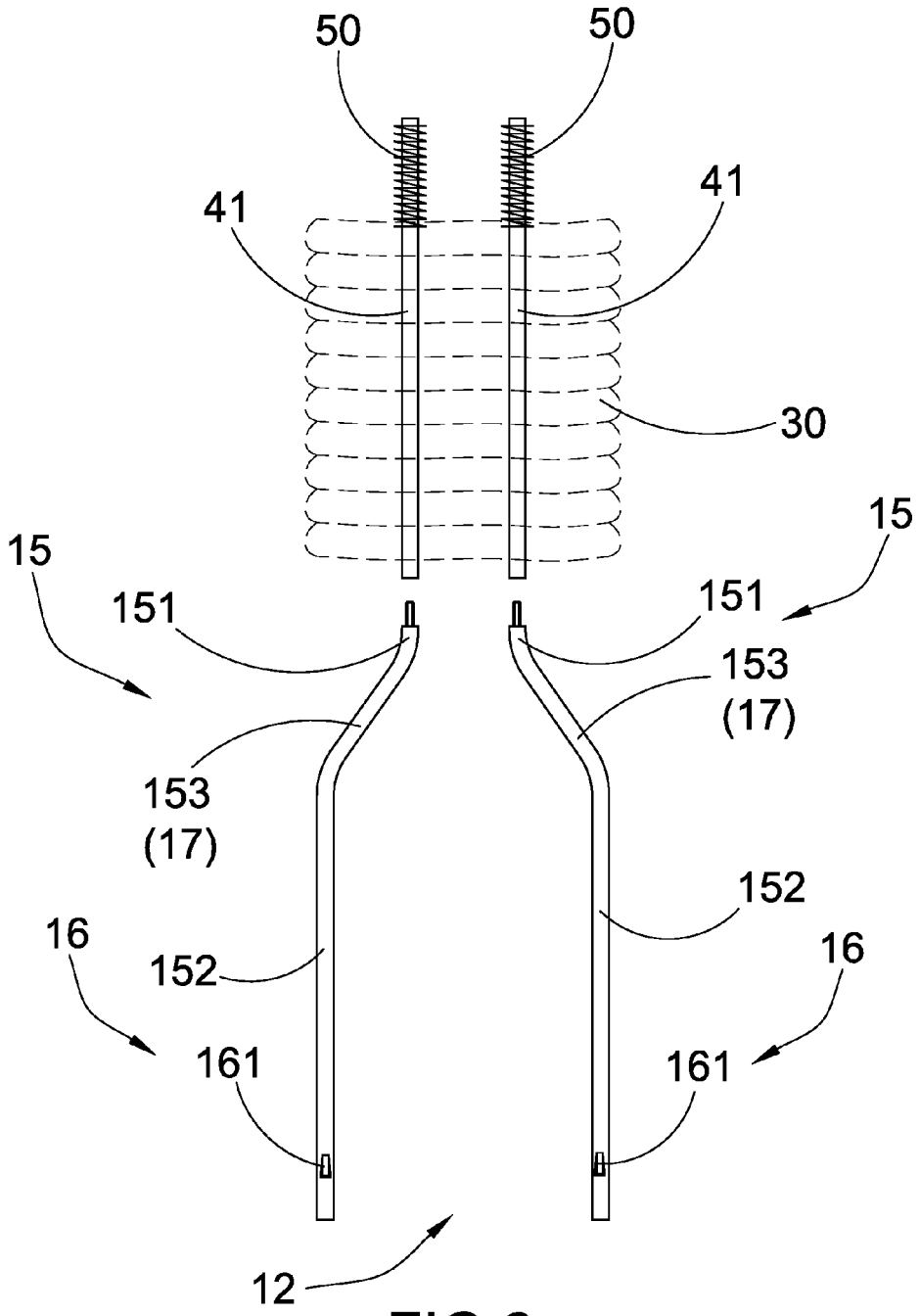
FIG. 2 illustrates a shoe cover cartridge of the automatic shoe cover dispenser according to the above preferred embodiment of the present invention, illustrating the dispensing arms detachably coupling to the guiding arms end-to-end.

As shown in FIG. 2, the dispenser system comprises two dispensing arms 15 extended from the cartridge cavity 11 to the shoe disposing opening 12 and detachably coupled with the guiding arms 41 end-to-end respectively, so as to guide the shoe covers 30 to dispense at the shoe disposing opening 12. Therefore, the standby shoe cover 30A is slidably pulled from the guiding arms 41 to the dispensing arm 15 during dispensing operation. Accordingly, when the shoe cover cartridge 20 is loaded in the cartridge cavity 11 of the dispenser system 10, the front free ends of the guiding arms 41 are coupled at the rear free ends of the dispensing arms 15 respectively. The shoe disposing opening 12 is formed at the front free ends of the dispensing arms 15.

Each of the dispensing arms 15 has a sliding portion 151 extended from the corresponding guiding arm 41 and an expanding portion 152 extended to the shoe disposing opening 12. Accordingly, the sliding portions 151 of the dispensing arms 15 are parallel with each other, wherein a distance between the sliding portions 151 of the dispensing arms 15 is the same as a distance between the guiding arms 41. Therefore, the shoe covers 30 can smoothly slide from the guiding arms 41 to the sliding portions 151 of the dispensing arms 15. The distance between the sliding portions 151 of the dispensing arms 15 is smaller than a distance between the expanding portions 152 of the dispensing arms 15 in such a manner that when the standby shoe cover 30A is slid at the expanding portions 152 of the dispensing arms 15, the cover opening 311 of the standby cover body 30A is expanded to open up the standby cover body 30A at the shoe disposing opening 12. Accordingly, the distance between the guiding arms 41, i.e. the distance between the sliding portions 151 of the dispensing arms 15, is smaller than a width of each of the shoe covers 30 such that the shoe cover 30 can be packed along the guiding arms 41 in a compact structure. In addition, the distance between the expanding portions 152 of the dispensing arms 15 is slightly smaller than the width of each of the shoe covers 30, such that when the standby shoe cover 30A is slidably pulled to support at the expanding portions 152 of the dispensing arms 15, the cover opening 311 of the standby shoe cover 30A is stretched by the expanding portions 152 of the dispensing arms 15 so as to open up the cover opening 311 of the standby cover body 30A. The width of the shoe cover 30 is defined between two sidewalls thereof.

As shown in FIG. 2, each of the dispensing arms 15 further has an outward bending portion 153 extended between the sliding portion 151 and the expanding portion 152 to guide the shoe covers 30 to slide from the sliding portion 151 and the expanding portion 152. Accordingly, the outward bending portion 153 of each of the dispensing arms 15 is a slanted arm integrally extended from the sliding portion 151 and the expanding portion 152 to gradually increase a distance between the dispensing arms 15. In other words, when the standby shoe cover 30A is slid from the sliding portions 151 to the expanding portions 152 through the outward bending portions 153, the standby shoe cover 30A will be gradually opened up so as to ensure the smooth sliding movement of the standby shoe cover 30A for opening up the cover opening 311 of the standby cover body 30A.

Accordingly, the dispensing arms 15 are the components of the dispenser system 10, wherein when the shoe cover cartridge 20 is coupled at the dispenser system 10, the guiding arms 41 can be coupled with the dispensing arms 15 respectively. It is worth mentioning that the dispensing arms 15 can be integrally extended from the guiding arms 41 such that the dispensing arms 15 can be configured as a component of the shoe cover cartridge 20 to be loaded into the dispenser system 10 when the shoe cover cartridge 20 is coupled at the dispenser system 10. In other words, the guiding arms 41 can be extended from the cartridge cavity 11 to the shoe disposing opening 12 after the shoe cover cartridge 20 to be loaded into the dispenser system 10.

The dispenser system 10 comprises a retention unit which comprises first and second stoppers 16, 17 spacedly provided at the shoe disposing opening 12 for engaging with the front and rear sides of the standby shoe cover 30A for retaining the standby shoe body 30A in an opened condition at the shoe disposing opening 12.

The first stopper 16 is provided close to the free ends the dispensing arms 15 while the second stopper 17 is provided at the expanding portions 152 of the dispensing arms 15 close to the sliding portions 151 thereof. When the standby shoe cover 30A is pulled at the shoe disposing opening 12, the front and rear sides of the standby shoe cover 30A are retained by the first and second stoppers 16, 17 respectively to retain the standby shoe cover 30A in an opened condition at the shoe disposing opening 12. When the rear side of the standby shoe cover 30A is pulled to detach from the free ends of the dispensing arms 15, the subsequent shoe cover 30B is pulled by the standby shoe cover 30A that the front and rear sides of the subsequent shoe cover 30B are retained by the first and second stoppers 16, 17 respectively so as to retain the subsequent shoe cover 30B in an opened condition at the shoe disposing opening 12 after the standby shoe cover 30A is dispensed. It is worth mentioning that once the rear side of the standby shoe cover 30A is pulled to detach from the free ends of the dispensing arms 15, the standby shoe cover 30A is removed from the dispenser system 10 to wrap at the shoe of the user.

Figure 2A:
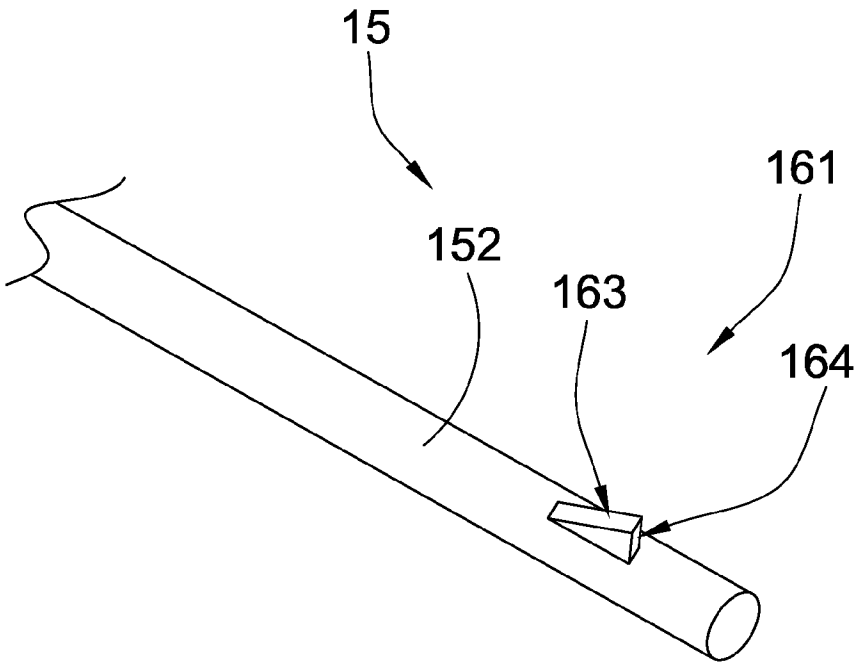
FIG. 2A illustrates the first stopper at the free end portion of the dispensing arm according to the above preferred embodiment of the present invention.

According to the preferred embodiment, the first stopper 16 comprises two first stopping members 161 upwardly and integrally protruded from two end portions of the dispensing arms 15 respectively, wherein each of the first stopping members 161 has a stopping surface to block the front side of the standby cover 30A from moving backward. Preferably, each of the first stopping members 161 has a triangular cross section defining a slanted top surface 163 extended from the dispensing arm 15 and a flat front surface 164 serving as the stopping surface, as shown in FIG. 2A. Therefore, the front side of the standby shoe cover 30A can frontwardly slide and pass the slanted top surfaces 163 of the first stopper members 161 at the dispensing direction via the first interlocking holes 321 toward the free front ends of the dispensing arms 15. Once the first interlocking holes 321 pass the first stopper members 161, the stopping surfaces of the first stopping members 161 will block the front side of the standby shoe cover 30A to move backward.

According to the preferred embodiment, the second stopper 17 is integrated with the dispensing arms 15, wherein the outward bending portion 153 of each of the dispensing arms 15 serves as the second stopper 17 to prevent the rear side of the standby shoe cover 30A moving backward. In other words, when the rear side of the standby shoe cover 30A is slid at the expanding portions 152 of the dispensing arms 15 through the outward bending portions 153 thereof, the rear side of the standby shoe cover 30A cannot slide back to the sliding portions 151 of the dispensing arms 15 due to the elasticity of the covering opening 311 of the standby shoe cover 30A.

As shown in FIG. 2, the automatic shoe cover dispenser further comprises a pushing feeder 50 supported in the cartridge cavity 11 for pushing the shoe covers 30 toward the shoe disposing opening 12 when the shoe cover cartridge 20 is loaded in the cartridge cavity 11. According to the preferred embodiment, the pusher feeder 50 comprises two resilient elements, preferably two compression springs, coaxially coupled at the guiding arms 41 respectively for applying a forward pushing force against the stack of the shoe covers 30 toward the shoe disposing opening 12.

Preferably, the resilient elements are coupled at the rear end portions of the guiding arms 41 respectively to push at the rearmost shoe cover 30.

It is worth mentioning that the pusher feeder 50 can be built-in with the shoe cover cartridge 20 that the resilient elements are coupled at the guiding arms 41 respectively. Therefore, the pusher feeder 50 will be replaced when the shoe cover cartridge 20 is unloaded from the dispenser system 10. Likewise, the pusher feeder 50 can be built-in with the dispenser system 10 that the pusher feeder 50 is supported at the cartridge cavity 11, such that when the shoe cover cartridge 20 is loaded in the cartridge cavity 11, the pusher feeder 50 is actuated to push the shoe covers 30 in the shoe cover cartridge 20. In other words, the pusher feeder 50 will not be replaced during the loading and unloading operation of the shoe cover cartridge 20.

Figure 5:
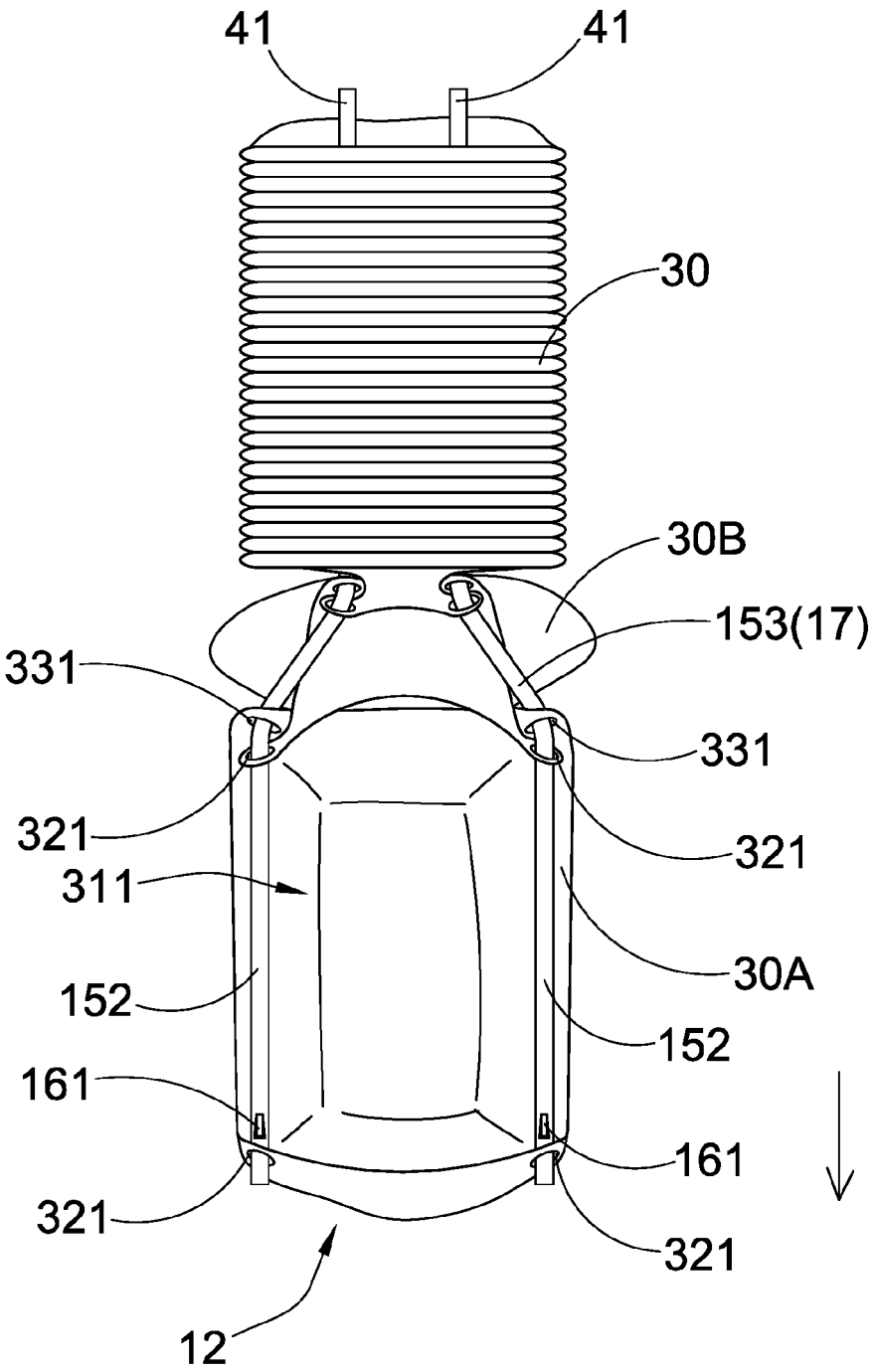
FIG. 5 illustrates the standby shoe cover being pulled at the shoe disposing opening of the dispenser system according to the above preferred embodiment of the present invention.

In order to dispense the shoe covers 30 through the dispenser system 10, the shoe cover cartridge 20 can be loaded into the dispensing system 10 through the rear opening 14 thereof. When the shoe cover cartridge 20 is loaded in the cartridge cavity 11, the guiding arms 41 are coupled at the dispensing arms 15 end-to-end respectively. Once the shoe cover cartridge 20 is loaded in the cartridge cavity 11, the shoe cover 30 at the foremost position can be pulled out from the cartridge cavity 11 to the shoe disposing opening 12, as shown in FIG. 5, which serves as the standby shoe cover 30A. When the standby shoe cover 30A is pulled to the shoe disposing opening 12 at the position that the first and second stoppers 16, 17 are engaged with the front and rear sides of the standby shoe cover 30A to open up the cover opening 311 of the standby shoe cover 30A between the front and rear sides thereof. Meanwhile, the cover opening 311 of the standby shoe cover 30A will also be opened up at the sidewalls thereof via the expanding portions 152 of the dispensing arms 15. It is worth mentioning that the subsequent shoe cover 30B is also pulled by the standby shoe cover 30A, as shown in FIG. 5.

Figure 6:
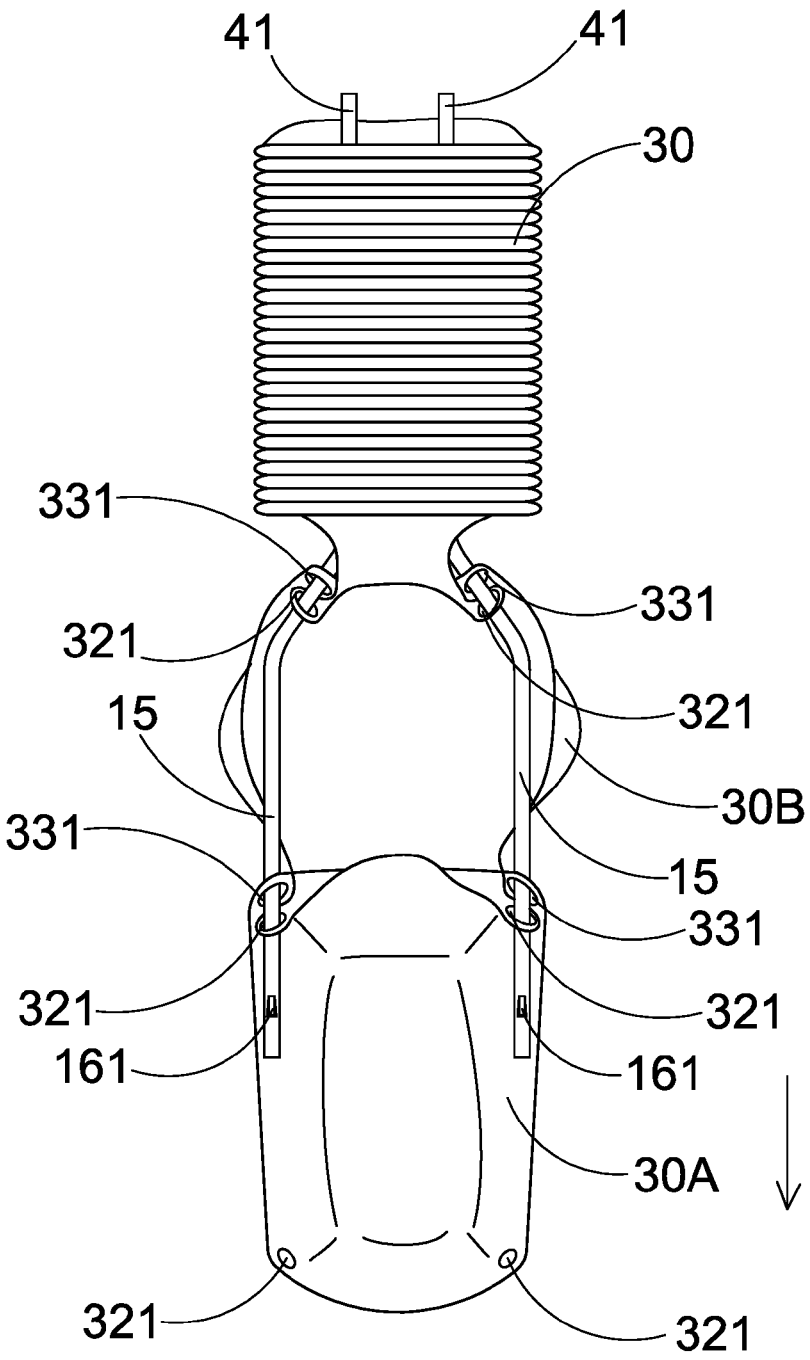
FIG. 6 illustrates the standby shoe cover being pulled out of the shoe disposing opening of the dispenser system according to the above preferred embodiment of the present invention.
Figure 7:
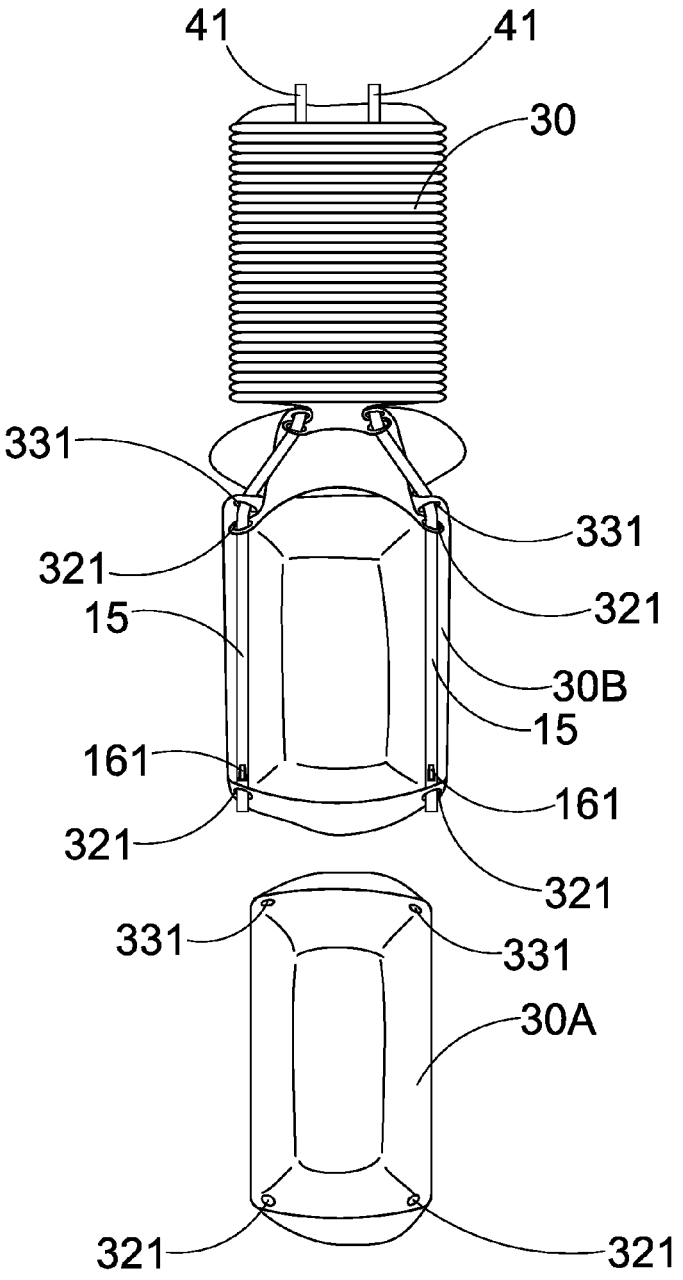
FIG. 7 illustrates the subsequent shoe cover being pulled at the shoe disposing opening of the dispenser system after the standby shoe cover is dispensed according to the above preferred embodiment of the present invention.

The user is able to put the foot in the standby shoe cover 30A through the cover opening 311 thereof that the shoe is located within the standby shoe cover 30A. Then, the user is able to drag the foot toward the front opening 13 of the dispenser system 10 to detach the standby shoe cover 30A therefrom. When applying the dragging force to the standby shoe cover 30A, the first interlocking holes 321 of the standby shoe cover 30A are slid out of the free ends of the dispensing arms 15 so as to detach the front side of the standby shoe cover 30A therefrom, as shown in FIG. 6. The dragging force at the standby shoe cover 30A will overcome the holding force at the second stopper 17, such that the rear side of the standby shoe cover 30A can be pulled forward. At the same time, the front side of the subsequent shoe cover 30B is pulled by the rear side of the standby shoe cover 30A toward the shoe disposing opening 11. By keep applying the dragging force to the standby shoe cover 30A, the second interlocking holes 331 of the standby shoe cover 30A are slid out of the free ends of the dispensing arms 15 so as to detach the rear side of the standby shoe cover 30A therefrom, as shown in FIG. 7. As a result, the standby shoe cover 30A will be entirely dispensed out of the dispensing arms 15. The elastic edge of the standby shoe cover 30A will shrink the cover opening 311 of the standby shoe cover 30A that the shoe of the user will be wrapped by the standby shoe cover 30A.

Once the rear side of the standby shoe cover 30A is detached from the dispensing arms 15, the interlock between the rear side of the standby shoe cover 30A and the front side of the consequent shoe cover 30B will be released. Since the dragging force will not be transmitted to the consequent shoe cover 30B once the standby shoe cover 30A is dispensed, the rear side of the consequent shoe cover 30B will be held by the second stopper 17 while the front side of the consequent shoe cover 30B will be moved back to engage with the dispensing arms 15. In particular, the first interlocking holes 321 will be engaged with the dispensing arms 15 respectively and will be blocked by the first stopper 16, as shown in FIG. 7. In other words, the consequent shoe cover 30B will be retained in an opened condition at the shoe disposing opening 12 and will become the standby shoe cover 30A once the standby shoe cover 30A is dispensed.

Figure 8:
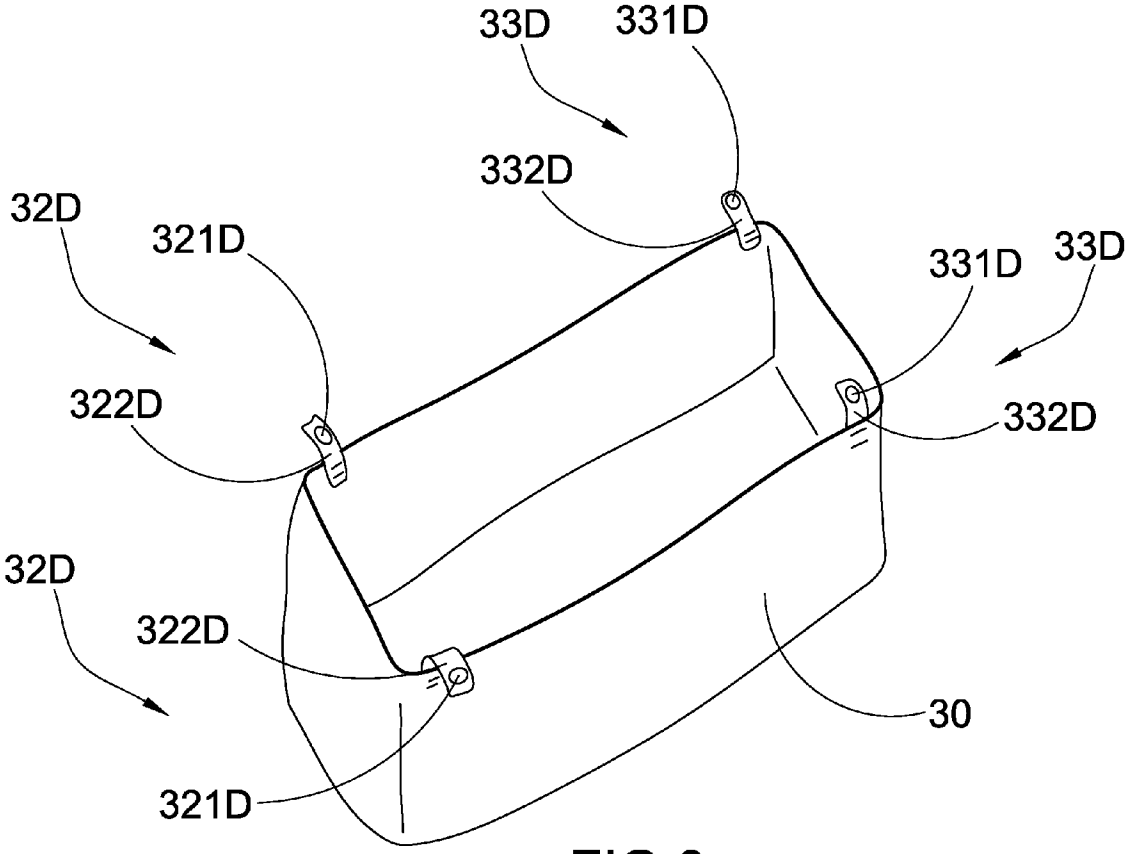
FIG. 8 illustrates a first alternative mode of the first and second interlocking units of the shoe cover according to the above preferred embodiment of the present invention.

FIG. 8 illustrates a first alternative mode of the first and second interlocking units 32D, 33D of the shoe cover 30 to interlock the shoe covers 30 with each other via the guiding arms 41. As shown in FIG. 8, the first interlocking unit 32D comprises two first flexible strips 322D upwardly extended from two sidewalls of the cover body 31 close to the front side thereof, wherein each of the first flexible strips 322D has a first interlocking hole 321 provided at a free end thereof. Likewise, the second interlocking unit 33D comprises two second flexible strips 332D upwardly extended from two sidewalls of the cover body 31 close to the rear side thereof, wherein each of the second flexible strips 332D has a second interlocking hole 331D provided at a free end thereof. The interlocking configuration of the first alternative mode is the same as that of the above mentioned embodiment, wherein the guiding arms 41 are arranged to slidably extend through the first and second interlocking holes 321D, 331D at the shoe covers 30. Therefore, the first interlocking holes 321D of the subsequent shoe cover 30B is located in front of the second interlocking hole 331D of the standby shoe cover 30A along the guiding arms 41. It is worth mentioning that the first and second flexible strips 322D, 332D can be upwardly extended from the front and rear sides of the cover body 31.

Figure 9:
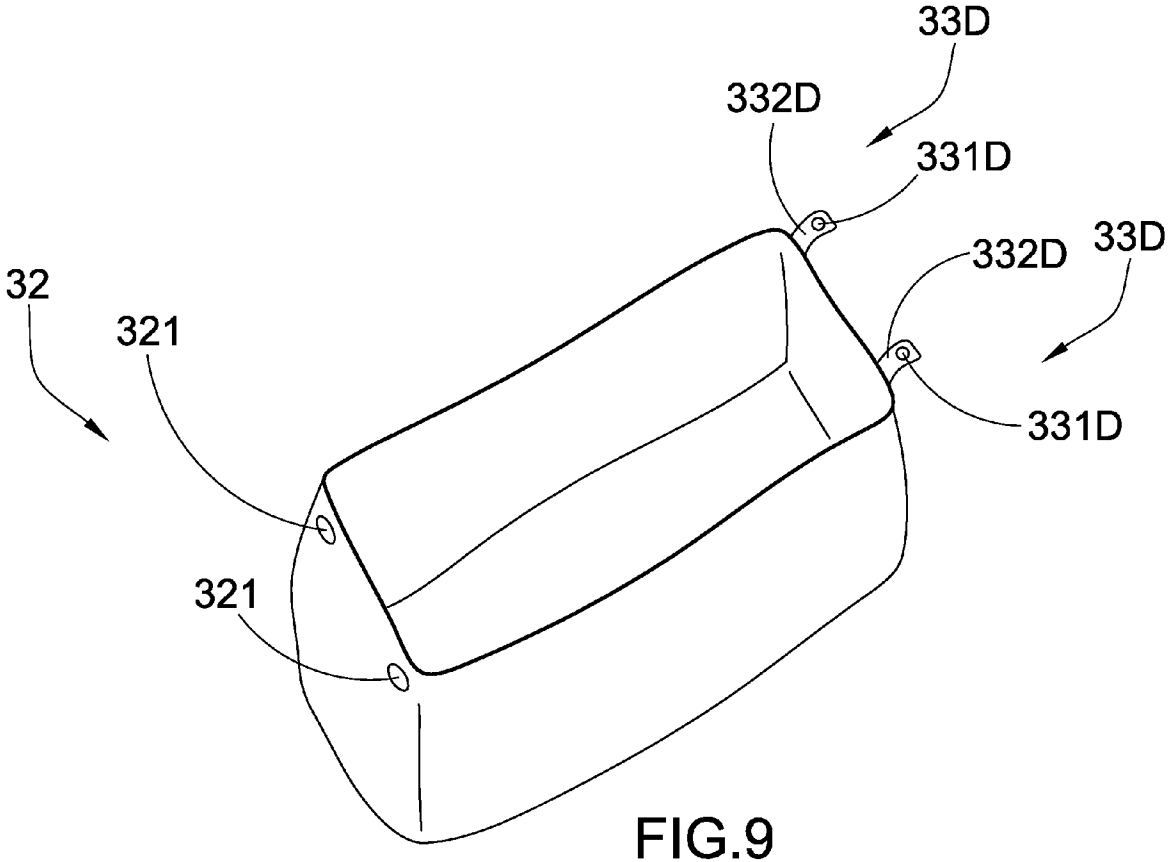
FIG. 9 illustrates a second alternative mode of the first and second interlocking units of the shoe cover according to the above preferred embodiment of the present invention.

FIG. 9 illustrates a second alternative mode of the first and second interlocking units 32, 33D of the shoe cover 30 to interlock the shoe covers 30 with each other via the guiding arms 41, wherein the second alternative mode is the combination of the first interlocking unit 32 of the preferred embodiment and the second interlocking unit 33D of the first alternative mode. As shown in FIG. 9, the first interlocking unit 32 contains two spaced apart first interlocking holes 321 formed at the front side of the cover body 31 below the top peripheral edge thereof. Each of the first interlocking holes 321 is a through hole formed at the front side of the cover body 30 close to the sidewall thereof. The second interlocking unit 33D comprises two second flexible strips 332D upwardly extended from rear side of the cover body 31, wherein each of the second flexible strips 332D has a second interlocking hole 331D.

Figure 10:
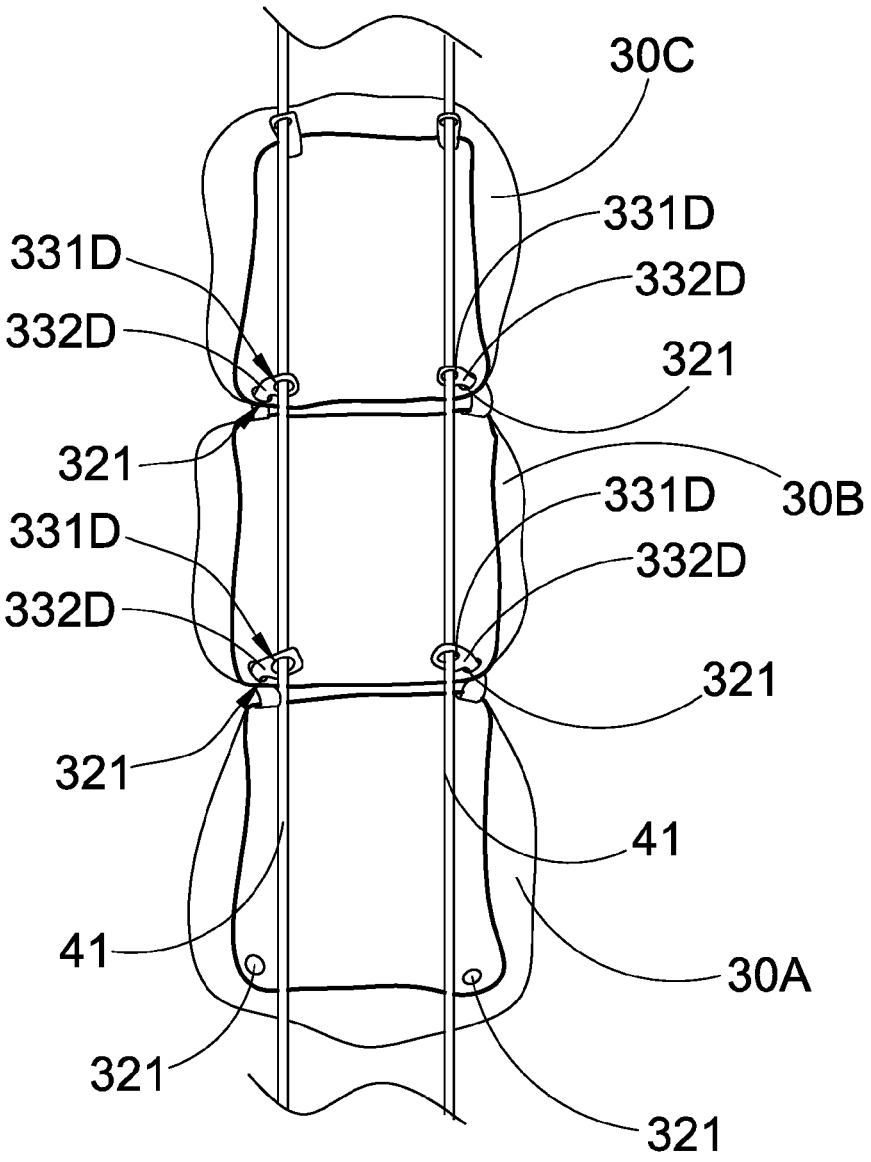
FIG. 10 illustrates the interlocking configuration of the second alternative mode of the first and second interlocking units of the shoe cover according to the above preferred embodiment of the present invention.

The interlocking configuration of the second alternative mode is slightly different from that of the above mentioned embodiment, wherein the guiding arms 41 are arranged to slidably extend through the second interlocking holes 331D at the shoe covers 30 only, as shown in FIG. 10. Accordingly, the second flexible strips 332D of the standby shoe cover 30A are extended through the first interlocking holes 321 of the consequent shoe cover 30B respectively. Once the second flexible strips 332D of the standby shoe cover 30A are extended through the first interlocking holes 321 of the consequent shoe cover 30B, the guiding arms 41 are extended through the second interlocking holes 331D. It is worth mentioning that the second flexible strips 332D of the standby shoe cover 30A not only support the rear side of the standby shoe cover 30A at the guiding arms 41 but also support the front side of the consequent shoe cover 30B at the guiding arms 41. As a result, when the rear side of the standby cover body 30A is pulled, the front side of the consequent cover body 30B will be concurrently pulled by the standby cover body 30A. It is worth mentioning that the guiding arms 41 can be arranged to slidably extend through the first and second interlocking holes 321, 331D at the shoe covers 30 that the first interlocking holes 321 of the subsequent shoe cover 30B is located in front of the second interlocking hole 331D of the standby shoe cover 30A along the guiding arms 41 as the same interlocking configuration as it is mentioned above.

Figure 11:
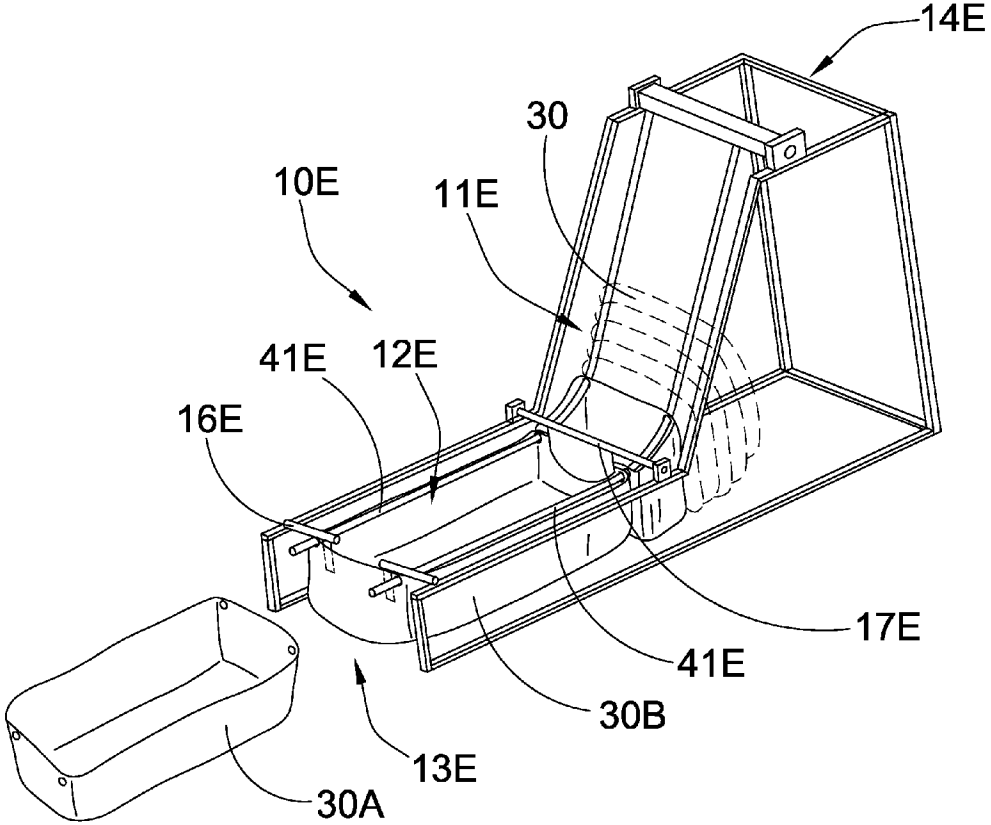
FIG. 11 illustrates a modification of the automatic shoe cover dispenser according to the above preferred embodiment of the present invention.
Figure 12:
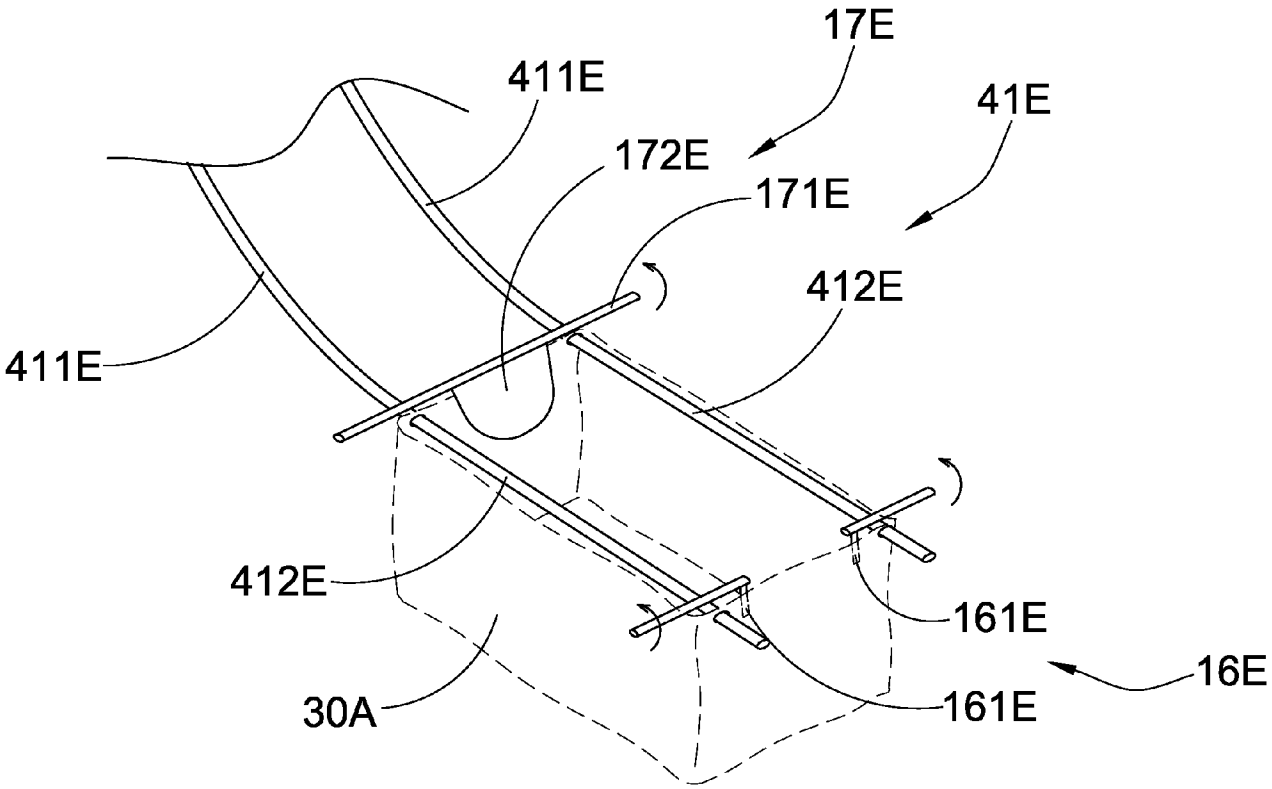
FIG. 12 illustrates the first and second stoppers of the modified automatic shoe cover dispenser according to the above preferred embodiment of the present invention.

FIG. 11 illustrates an alternative mode of the of the automatic shoe cover dispenser as a modification thereof. The dispenser system 10E has a L-shaped configuration, wherein the cartridge cavity 11E is formed at a rear top portion of the dispenser system 10E and the shoe disposing opening 12E is formed at a front portion of the dispenser system 10E at a top side thereof. Therefore, the shoe disposing opening 12E is a top front opening at the front portion of the dispenser system 10E. The dispenser system 10E further has a front opening 13E communicating with the shoe disposing opening 12E and a top rear opening 14E communicating with the cartridge cavity 11E. Therefore, the shoe cover cartridge 20 can be loaded and unloaded in the cartridge cavity 11E through the shoe disposing opening 12E.

Due to the L-shaped dispenser system 10E, the guiding arms 41E are downwardly extended from the cartridge cavity 11E to the shoe disposing opening 12E. Each of the guiding arms 41E has a downward curving portion 411E extended from the cartridge cavity 11E and a horizontal portion 412E extended to the shoe disposing opening 12E. In other words, the dispensing arms 15 as mentioned above are integrally formed with the guiding arms 41E to form two integrated arm structures.

Accordingly, each of the guiding arms 41E can be embodied as a wire made of stiff material such as metal. Preferably, the guiding arms 41E are two flat metal wires extended from the cartridge cavity 11E to the shoe disposing opening 12E. Furthermore, the first and second stoppers 16E, 17E are spacedly provided at the shoe disposing opening 12E for engaging with the front and rear sides of the standby shoe cover 30A for retaining the standby shoe body 30A in an opened condition at the shoe disposing opening 12E.

Each of the first stoppers 16E, preferably having a L-shaped configuration, has a resilient portion 161E extended at the front opening 13E of the dispenser system 10E, wherein the resilient portions 16E of the first stoppers 16E are arranged for applying a resilient force against the front side of the standby shoe cover 30A to retain the standby shoe cover 30A in an opened condition. It is worth mentioning that when the standby shoe cover 30A is dragged by the user, the dragging force will overcome the resilient force to pull the standby shoe cover 30A out of the dispenser system 10E from the front opening 13E. Preferably, the resilient portions 16E of the first stoppers 16E are downwardly, vertically, and spacedly extended between the guiding arms 41E.

The second stopper 17E comprises a rotatable shaft 171E rotatably coupled at the dispenser system 10E and a blocking member 172E extended from the rotatable shaft 171E between the guiding arms 41E for holding the rear side of the standby shoe cover 30A to retain the standby shoe cover 30A in an opened condition. Likewise, when the standby shoe cover 30A is dragged by the user, the dragging force will drive the rotatable shaft 171E to rotate to disengage the blocking member 172E with the rear side of the standby shoe cover 30A so as to pull the standby shoe cover 30A out of the dispenser system 10E from the front opening 13E. Preferably, the rotatable shaft 171E is supported above the horizontal portion 412E of the guiding arms 41E while the blocking member 172E is downwardly extended from the rotatable shaft 171E between the horizontal portions 412E of the guiding arms 41E.

Once the standby shoe cover 30A is dispensed to release the dragging force transmitted to the subsequent shoe cover 30B, the rotatable shaft 171E is rotated back to its original position. Therefore, the blocking member 172E is engaged with the rear side of the subsequent shoe cover 30B. At the same time, the front side of the subsequent shoe cover 30B is held by the resilient portions 16E of the first stoppers 16E, such that the subsequent shoe cover 30B is held at the shoe disposing opening 12E in an opened condition after the standby shoe cover 30A is dispensed.

Figure 13:
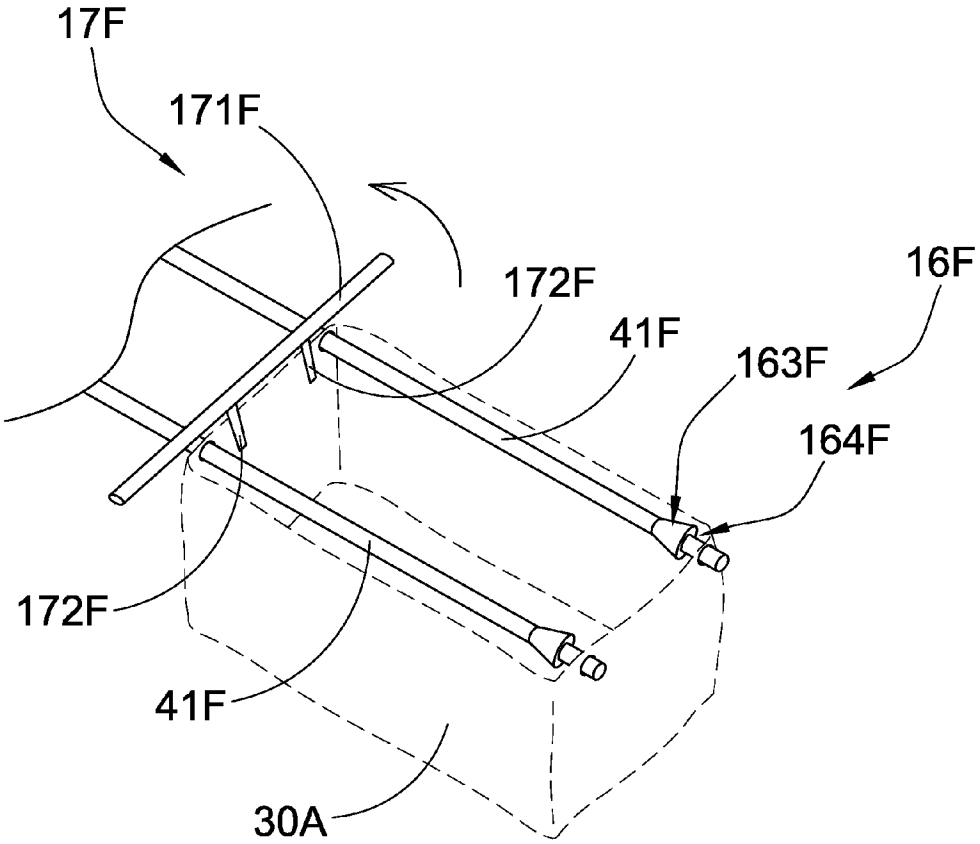
FIG. 13 illustrates another alternative of the first and second stoppers of the modified automatic shoe cover dispenser according to the above preferred embodiment of the present invention.

Alternatively, each of the first stoppers 16F, preferably having a conical-shaped configuration, is integrally and radially extended from the corresponding guiding arm 41F, wherein each of the first stoppers 16F a slanted circumferential surface 163F extended from the guiding arm 41F and a flat front surface 164F serving as the stopping surface, as shown in FIG. 13. The second stopper 17F comprises a rotatable shaft 171F rotatably coupled at the dispenser system 10E and at least one resilient portion 172F, preferably two spaced apart resilient portions 172F, extended from the rotatable shaft 171F for holding the rear side of the standby shoe cover 30A to retain the standby shoe cover 30A in an opened condition.

Figure 14:
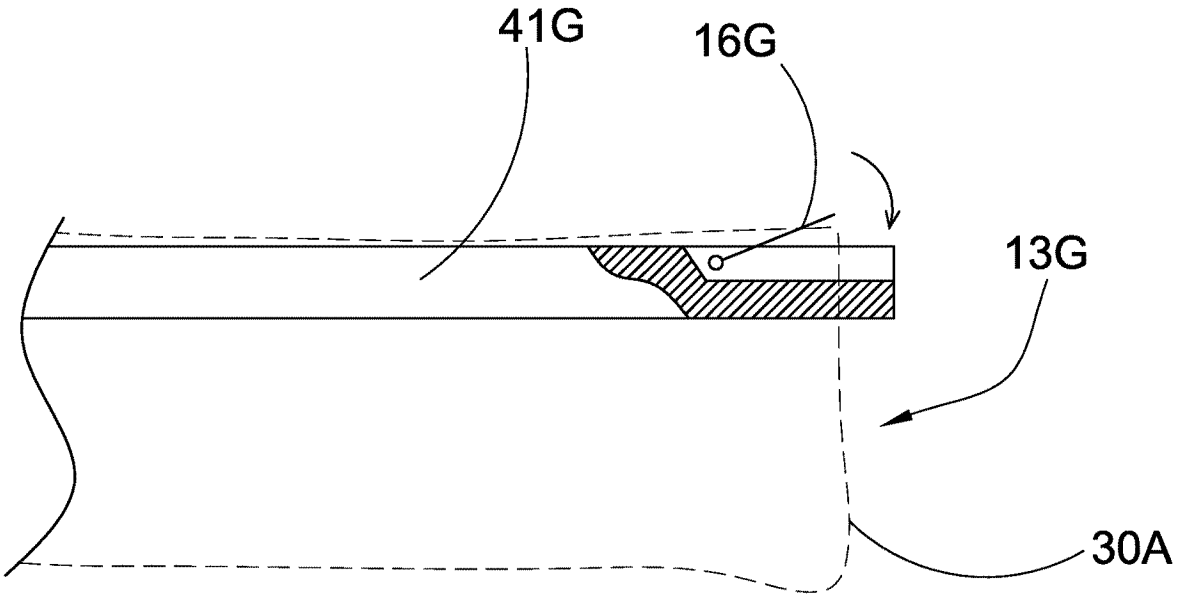
FIG. 14 illustrates a third alternative mode of the first stopper of the modified automatic shoe cover dispenser according to the above preferred embodiment of the present invention.

FIG. 14 illustrates another alternative mode of the first stopper 16G provided at the guiding arm 41G. The first stopper 16G has a pivot end pivotally extended from the guiding arm 41G and a free end inclinedly extended from the guiding arm 41G toward the front opening 13G. The first stopper 16G allows the standby shoe cover 30A to slide at one direction, i.e. the dispensing direction, toward the front opening 13G.

Figure 15:
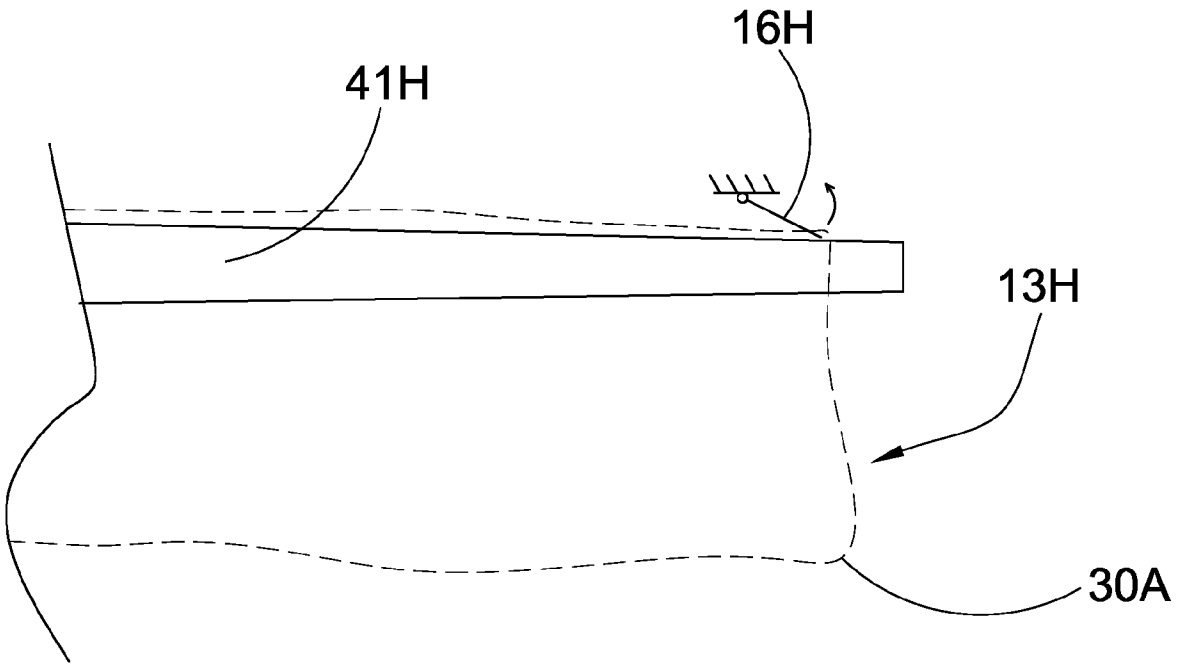
FIG. 15 illustrates a fourth alternative mode of the first stopper of the modified automatic shoe cover dispenser according to the above preferred embodiment of the present invention.

FIG. 15 illustrates another alternative mode of the first stopper 16H extended to the guiding arm 41H. The first stopper 16H is pivotally and inclinedly extended at a position that the free end thereof is extended to contact with the guiding arm 41H toward the front opening 13H. The first stopper 16H allows the standby shoe cover 30A to slide at one direction, i.e. the dispensing direction, toward the front opening 13H.

Figure 16:
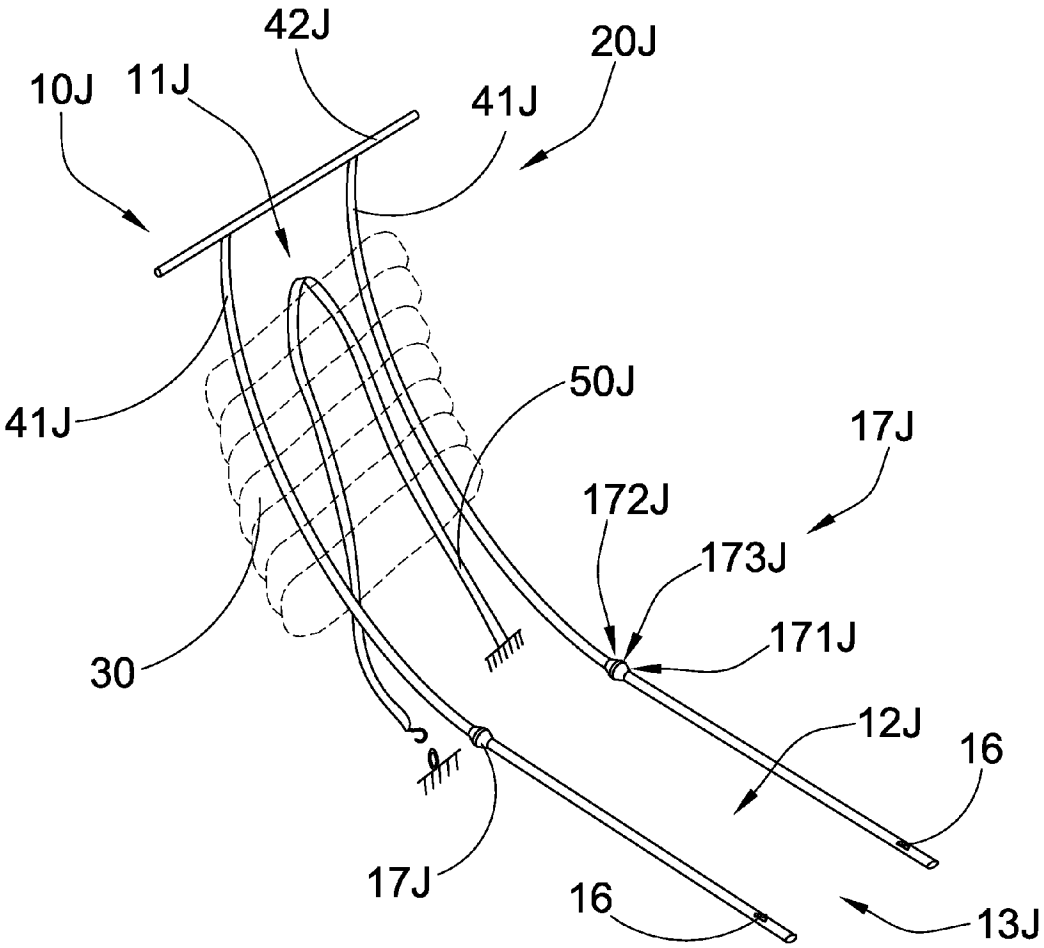
FIG. 16 illustrates a fifth alternative mode of the first stopper of the modified automatic shoe cover dispenser according to the above preferred embodiment of the present invention.

FIG. 16 illustrates another alternative mode of the of the automatic shoe cover dispenser. The shoe cover cartridge 20J further comprises a transverse member 42J extended from the upper ends of the guiding arms 41J, wherein the transverse member 42J is detachably supported by the dispenser system 10J to retain the guiding arms 41J in position. Each of the second stoppers 17J is integrally and radially extended from the corresponding guiding arm 41J, wherein each of the second stoppers 17K a front slanted circumferential surface 171J extended from the guiding arm 41F, a rear slanted circumferential surface 172J extended to the guiding arm 41F toward the front opening 13J, and a flat circumferential surface 173J extended between the front and rear slanted circumferential surfaces 171J, 172J, which serves as the stopping surface, as shown in FIG. 16.

The pushing feeder 50J is supported in the cartridge cavity 11J for pushing the shoe covers 30 toward the shoe disposing opening 12J. According to the preferred embodiment, the pusher feeder 50J comprises an elastic band having two ends detachably secured in the cartridge cavity 11J for applying a forward pushing force against the stack of the shoe covers 30 toward the shoe disposing opening 12J.

Figure 17:
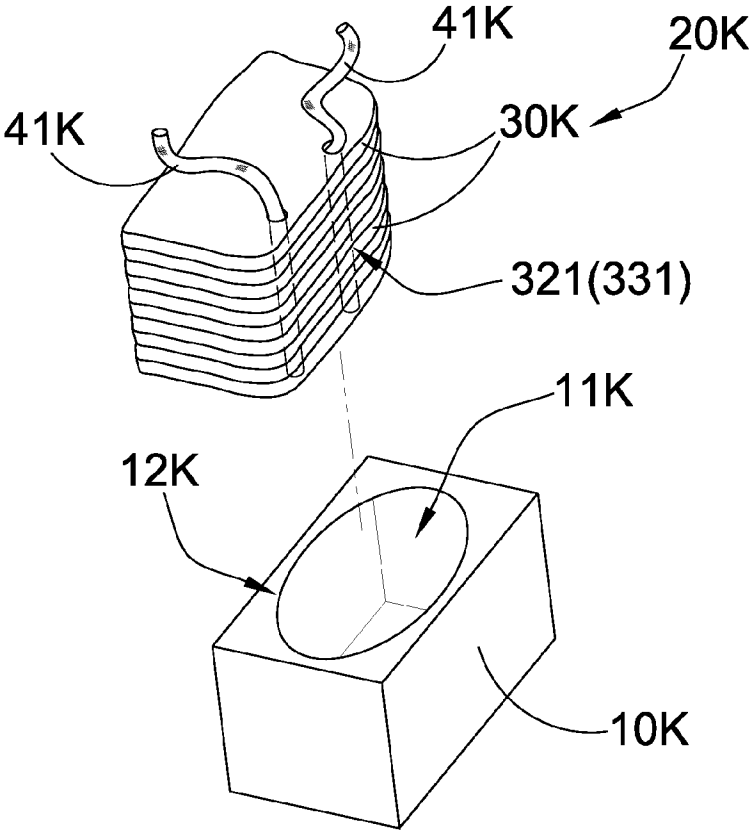
FIG. 17 illustrates an alternative mode of the shoe cover cartridge of the shoe cover dispenser according to the above preferred embodiment of the present invention, illustrating the shoe covers being manually pulled one-by-one from the shoe cover dispenser.

FIG. 17 illustrates an alternative mode of the shoe cover cartridge 20K for the dispenser system 10K according to the above preferred embodiment of the present invention, wherein the shoe covers 30K being manually pulled one-by-one from the dispenser system 10K.

As it is mentioned above, the shoe covers 30K are overlapped with each other in a sequential manner that the shoe cover at the outermost position is arranged to be pulled into an open-up condition as a standby shoe cover 30K and a subsequent shoe cover 30K followed by the standby shoe cover 30K. The interlocking arrangement between two shoe covers 30K is the same as the above mentioned embodiment and its alternative modes. Therefore, when the standby shoe cover 30K is arranged for being pulled, the subsequent shoe cover 30K is pulled by the standby shoe cover 30K, so as to dispense the shoe covers 30K one-by-one in a sequential order.

According to the alternative mode, the shoe cover cartridge 20K further comprises a guiding unit 40K which comprises two spaced apart elongated guiding arms 41K extended parallelly with each other. Each of the guiding arms 41K is a flexible guiding cable retain the shoe covers 30K in an overlapped manner, wherein the front and rear interlocking units 321, 331 are slidably engaged with the guiding arms 41K at a position that the front interlocking unit 321 at the subsequent shoe cover 30K is located in front of the rear interlocking unit 331 at the standby shoe cover 30K along the guiding arms 41K. Therefore, when the standby shoe cover 30K is pulled at the dispensing direction, the subsequent shoe cover 30K is pulled by the standby shoe cover 30K, so as to dispense the shoe covers 30K in a sequential order.

As shown in FIG. 17, the dispenser system 10K, having a box shape, has a cartridge cavity 11K and a shoe disposing opening 12K, wherein the shoe cover cartridge 20K is stored in the cartridge cavity 11K. In particular, the shoe covers 30K are overlapped and stored in the cartridge cavity 11K at a position that the standby shoe cover 30K is pulled out of the cartridge cavity 11K through the shoe disposing opening 12K. It is worth mentioning that the dispenser system 10K can be a paper box or a plastic box, wherein the shoe cover cartridge 20K can be re-filled in the dispenser system 10K. Therefore, the user is able to manually pull the shoe cover 30K one-by-one from the dispenser system 10K.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A shoe cover cartridge, comprising:

a plurality of shoe covers overlapped with each other in a sequential manner that said shoe cover at the outermost position is arranged to be pulled into an open-up condition as a standby shoe cover and a subsequent shoe cover followed by said standby shoe cover;

an elongated guiding arm; and an interlocking arrangement which comprises a first interlocking unit provided at a front side of each of said shoe covers, and a second interlocking unit provided at a rear side of each of said shoe covers, wherein said first interlocking unit contains at least a first interlocking hole formed at said front side of each of said shoe covers while said second interlocking unit contains at least a second interlocking hole formed at said rear side of each of said shoe covers such that said front side of each of said shoe covers is slidably engaged with said guiding arm of a automatic shoe cover through said first interlocking hole and said rear side of each of said shoe covers is slidably engaged with said guiding arm of the automatic shoe cover through said second interlocking hole to retain said shoe covers in an overlapped manner, wherein said first interlocking unit at said subsequent shoe cover is located in front of said second interlocking unit at said standby shoe cover, such that when said standby shoe cover is arranged for being pulled, said front side of said subsequent shoe cover is pulled by said rear side of said standby shoe cover to make said subsequent shoe cover be pulled by said standby shoe cover, so as to dispense said shoe covers one-by-one in a sequential order.

2. The shoe cover cartridge, as recited in claim 1, further comprising means for applying a forward pushing force against said shoe covers toward a shoe disposing opening of a shoe cover dispenser.

3. The shoe cover cartridge, as recited in claim 1, wherein said second interlocking hole of said standby shoe cover is arranged for being passed through the guiding arm before said first interlocking hole of said subsequent shoe cover is arranged for being passed through the guiding arm.

4. The shoe cover cartridge, as recited in claim 3, wherein two of said first interlocking holes are spacedly formed at said front side of each of said shoe covers at a position close to two sidewalls thereof, and two of said second interlocking holes are spacedly formed at said rear side of each of said shoe covers at a position close to two sidewalls thereof.

5. The shoe cover cartridge, as recited in claim 1, wherein said first interlocking unit comprises at least a first flexible strip, having a first interlocking hole, extended from said front side of each of said shoe covers while said second interlocking unit comprises at least a second flexible strip, having a second interlocking hole, extended from said rear side of each of said shoe covers, wherein said first and second interlocking holes are arranged for slidably engaging with said guiding arm so as to retain said shoe covers in an overlapped manner.

6. The shoe cover cartridge, as recited in claim 5, wherein said second interlocking hole of said standby shoe cover is arranged for being passed through the guiding arm before said first interlocking hole of said subsequent shoe cover is arranged for being passed through the guiding arm.

7. The shoe cover cartridge, as recited in claim 5, wherein two of said first flexible strips are extended from two sidewalls of each of said shoe covers at a position close to said front side thereof, and two of said second flexible strips are extended from said two sidewalls of each of said shoe covers at a position close to said rear side thereof.

8. The shoe cover cartridge, as recited in claim 6, wherein two of said first flexible strips are extended from two sidewalls of each of said shoe covers at a position close to said front side thereof, and two of said second flexible strips are extended from said two sidewalls of each of said shoe covers at a position close to said rear side thereof.

9. The shoe cover cartridge, as recited in claim 1, wherein said first interlocking unit comprises two first flexible strips, each having a first interlocking hole, extended from said front side of each of said shoe covers while said second interlocking unit comprises two second flexible strips, each having a second interlocking hole, extended from said rear side of each of said shoe covers.

10. The shoe cover cartridge, as recited in claim 9, further comprising two elongated guiding arms, wherein said second flexible strips at said standby shoe cover are extended through said first interlocking holes at said subsequent shoe cover respectively, wherein said second interlocking holes are arranged for slidably engaging with said guiding arms so as to retain said shoe covers in an overlapped manner.

11. The shoe cover cartridge, as recited in claim 1, further comprising a shoe cover dispenser having a cartridge cavity and a shoe disposing opening, wherein said shoe covers are overlapped and stored in said cartridge cavity at a position that said standby shoe cover is pulled out of said cartridge cavity through said shoe disposing opening.

* * * * *